US008205963B2

(12) United States Patent
Goto et al.

(10) Patent No.: US 8,205,963 B2
(45) Date of Patent: Jun. 26, 2012

(54) INK JET PRINT HEAD, AND METHOD OF MANUFACTURING INK JET PRINT HEAD

(75) Inventors: Akira Goto, Yokohama (JP); Minoru Nozawa, Yokohama (JP); Tomoyuki Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 411 days.

(21) Appl. No.: 12/483,798

(22) Filed: Jun. 12, 2009

(65) Prior Publication Data

US 2009/0309928 A1 Dec. 17, 2009

(30) Foreign Application Priority Data

Jun. 17, 2008 (JP) ..... 2008-158204

(51) Int. Cl.
*B41J 2/14* (2006.01)
*B41J 2/16* (2006.01)

(52) U.S. Cl. ..... 347/47; 347/50

(58) Field of Classification Search ..... None
See application file for complete search history.

(56) References Cited

U.S. PATENT DOCUMENTS

2005/0078143 A1* 4/2005 Shimomura et al. ..... 347/20
2007/0211115 A1* 9/2007 Ibe et al. ..... 347/58

FOREIGN PATENT DOCUMENTS

JP 7-323549 12/1995
JP 11-28808 A 2/1999
JP 2005-132102 5/2005
JP 2006-224527 A 8/2006

* cited by examiner

*Primary Examiner* — Matthew Luu
*Assistant Examiner* — Renee I Wilson
(74) *Attorney, Agent, or Firm* — Fitzpatrick, Cella, Harper & Scinto

(57) ABSTRACT

An ink jet print head, which can prevent test terminals from coming into contact with ink or moisture and thus being corroded or damaging other circuits or wires, includes a nozzle forming member that is located in the vicinity of an area with the test terminals arranged therein and is separated from a nozzle forming member located in the remaining area so as to have a reduced volume.

11 Claims, 10 Drawing Sheets

INK JET PRINT HEAD, AND METHOD OF MANUFACTURING INK JET PRINT HEAD

BACKGROUND OF THE INVENTION

1. Field of the Invention

The present invention relates to an ink jet print head that performs printing by ejecting ink from ejection ports formed in a substrate, and more specifically, to an ink jet print head with test terminals arranged on the substrate.

2. Description of the Related Art

Common ink jet print heads (hereinafter simply referred to as print heads) use electrothermal transducing elements or electromechanical transducing elements as elements generating energy required to eject ink. Such print heads apply pulsed electric energy to the transducing elements or instantaneously change potential to allow ink to be ejected at a driving frequency of several kHz to 100 kHz. In a print head using electrothermal transducing elements, a current of several to several hundred mA normally flows per element. Thus, switching is preferably performed using power transistors or the like. Elements for driving including transistors are formed on a silicon substrate during the same manufacturing process by which semiconductors are manufactured.

The operation of such an actual circuit is checked using a dummy circuit called a test element group (TEG) as in the case of semiconductors. However, the dummy circuit does not necessarily offer the same characteristics as those of the actual circuit to be measured, wires are preferably drawn out directly from the actual circuit and guided to test terminals for checks.

Such test terminals are not involved in actual driving of print head. Thus, as disclosed in Japanese Patent Laid-Open No. H07-323549 (1995), the test terminals are provided separately from terminals receiving printing signals, normally at positions where the test terminals avoid affecting the size of the substrate.

FIG. 8 is a diagram showing a print head 1001 which is an example of a conventional print head and which ejects pigment black ink. The print head 1001 includes a print element substrate 1008 consisting of a nozzle forming member 1033 and a substrate 1021 which formed a printing element that uses a heater as an energy generating element. The heater heats ink to allow ink droplets to be ejected under the action of film boiling. Furthermore, the print head 1001 includes an electric wiring substrate 1002 that transmits driving signals and the like from an ink jet printing apparatus, and an electric connection sealing portion 1007 that insulates and protects the electric connection between the print element substrate 1008 and the electric wiring substrate 1002.

FIG. 9 is a partly enlarged perspective view of a portion of the print head 1001 which ejects ink. For facilitation of description, the figure shows only a part of the electric connection sealing portion 1007 (a hatched portion in the figure corresponds to a cross section of the omitted portion). Heaters (not shown in the drawings), elements for driving (not shown in the drawings), test terminals 1025, and connection terminals 1022 are patterned on the substrate 1021; leads 1024 from the electric wiring substrate 1002 are joined to the connection terminals 1022. A nozzle forming member 1033 is provided on the substrate 1021 so as to form nozzles that communicate with ejection port 1028. An intermediate layer 1027 is provided between the nozzle forming member 1033 and the substrate 1021.

The test terminal is arranged at an end of the print element unnecessarily enlarging the size of the print element substrate 1008. The test terminals are also covered with the nozzle forming member or the intermediate layer 1027 and thus protected from ink. Moreover, as disclosed in Japanese Patent Laid-Open No. 2005-132102, a sealing compound 1030 is of a thermosetting type similarly to the electric connection sealing portion 1007. This prevents the ink from entering the test terminals.

FIG. 10 is a circuit diagram showing a part of a circuit on the substrate 1021 with the test elements. During driving, a current is passed through a terminal 1 (power source) and a terminal 2 (GND) to actuate the heater to cause bubbling and the subsequent ink ejection. On the other hand, one of the check items required to determine whether or not the substrate 1021 is acceptable is to determine whether or not an illustrated transistor portion exhibits a predetermined resistance value to provide proper driving. In this case, the resistance value is measured between test terminals A and B to directly measure the resistance value of the transistor portion to determine whether or not the substrate 1021 is acceptable.

However, the thermosetting epoxy resin making up the sealing compound 1030 and the electric connection sealing portion 1007 causes stress on the nozzle forming member under the action of heat during hardening. The stress may warp the nozzle forming member to peel off from the substrate 1021 an end of the nozzle forming member, resulting in a gap 1032. The test terminals 1025 are often arranged in the end of a substrate so as to prevent an increase in the size of the substrate 1021. Therefore the test terminals 1025 are often arranged in the vicinity of the position where the gap 1032 is created. Accordingly in some cases, the test terminals 1025 may be connected to the exterior via the very small gap and come into contact with ink or moisture. As shown in FIG. 10, the test terminal A has a high potential with respect to the ground (GND). There is a possibility that trouble occurs when ink or moisture touches the terminal A.

Furthermore, if the test terminals 1025 are covered with gold plating with a thickness of, for example, 5 μm and the intermediate layer 1027 is about 3 to 5 μm in thickness, then the intermediate layer on the gold-plated test terminals 1025 is only at most 2 μm in thickness. In this condition, when the nozzle forming portion is peeled off, partly because gold originally exhibits improper responsiveness, the intermediate layer 1027 on the test terminals 1025 may be peeled off together with the nozzle forming portion. As a result, the test terminals 1025 may be connected to the exterior via the very small gap and come into contact with ink or moisture. A trouble may be caused in the terminal A.

Moreover, it is assumed that the intermediate layer 1027 is adapted to provide the functions of an insulating layer. Then, if the intermediate layer 1027 on the gold-plated test terminals 1025 is broken, even when the broken part is filled with the sealing compound, ions may migrate through the nozzle forming member to affect the test terminals 1025. Such effect of the test terminals 1025 does not directly affect the ink jet print head. However, if any potential is applied to the print head as in the case of the test terminal A in FIG. 10, then the effect may infrequently propagate through the wiring in the substrate 1021 toward the part with the higher potential, thus damaging circuits or wires in the substrate 1021.

SUMMARY OF THE INVENTION

Thus, an object of the present invention is to provide an ink jet print head that prevents test terminals from coming into contact with ink or moisture and thus being caused trouble or damaging other circuits or wires.

In an aspect of the present invention, an ink jet print head comprising a substrate including a nozzle in communication with ejection port through which ink is ejected, a circuit with a transducing element generating energy used to eject the ink, and a test terminal used to inspect the circuit, wherein a member forming the nozzle has a continuous recess portion, and is divided by the recess portion into a first area located in the vicinity of the test terminal and a second area larger than the first area.

According to the present invention, a recess portion that is continuous with a member forming a nozzle is provided. The member forming the nozzle is divided by the recess portion into a first area located in the vicinity of a test terminal and a second area larger than the first area. The present invention has allowed provision of an ink jet print head that prevents the test terminals from coming into contact with ink or moisture and thus being caused trouble or damaging other circuits or wires.

Further features of the present invention will become apparent from the following description of exemplary embodiments (with reference to the attached drawings).

DESCRIPTION OF THE EMBODIMENTS

First Embodiment

A first embodiment of the present invention will be described with reference to the drawings.

Figure 1A:
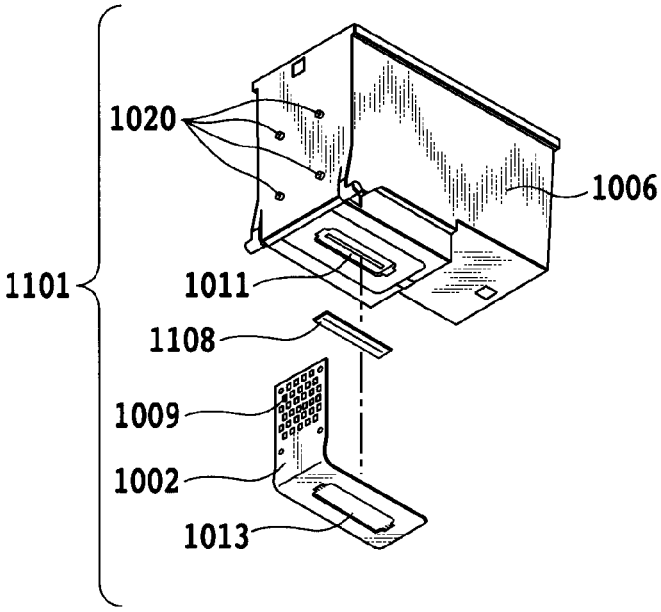
FIG. 1A is a perspective view of parts of an ink jet print head for black ink.
Figure 1B:
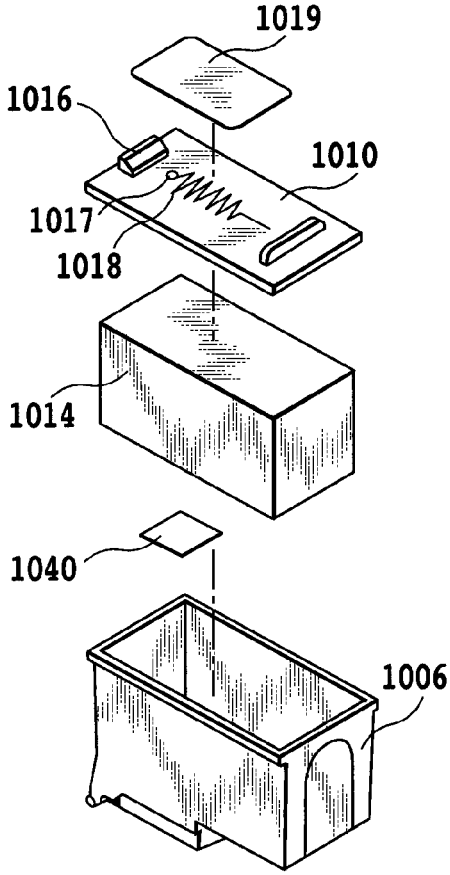
FIG. 1B is a perspective view of the parts of the ink jet print head for black ink.

FIGS. 1A and 1B are perspective views of parts of an ink jet print head (hereinafter simply referred to as a print head) 1101 for black ink. FIG. 1A shows the print head as viewed from a print element 1108 side. FIG. 1B shows the print head as viewed from a tank cover 1010 side. The print head 1101 according to the present embodiment is divided into a print head 1011 that ejects ink and a tank portion 1006 in which ink is stored. The print element substrate 1108 and an electric wiring substrate 1002 are connected together via an electric connection portion and accurately fixed to a predetermined position on the ink tank 1006 with an adhesive. The print head 1011, to which the print element substrate 1008 is joined, is lower than an area to which the electric wiring substrate 1002 is joined. The electric connection portion, via which the print element substrate 1108 and the electric wiring substrate 1002 are connected together, is insulated and protected by an electric connection sealing portion 1007. The area between the periphery of the print element 1108 other than the electric connection portion and a device hole 1013 in the electric wiring substrate 1002 is also preferably sealed with a sealing compound.

The electric wiring substrate 1002 is folded. The electric wiring substrate 1002 is fixed to a side surface of the tank portion 1006 by thermally caulking pins 1020 projecting through a side surface of the tank portion 1006, on a surface of the electric wiring substrate 1002 with terminals 1009 via which the ink jet printing apparatus main body and the electric wiring substrate 1002 transmit and receive electric signals to and from each other.

An ink filter 1040 is soldered to a predetermined position on the tank portion 1006. A negative pressure generating mechanism 1014 is provided in the tank portion 1006. A tank cover 1010 is soldered to the tank portion 1006 to form an ink storage portion. The tank cover 1010 includes an air communication port 1017, a thin groove 1018 that communicates with the air communication port 1017, and an area 1016 on which a load is imposed when the tank portion is installed in the ink jet printing apparatus main body; the air communication port 1017, the thin groove 1018, and the area 1016 are integrated with the tank cover 1010. A label 1019 having ink color information and the like is stuck to the top of the tank cover 1010.

In the ink jet print head according to the present embodiment, a thermosetting sealing compound is used for the sealing compound 1030 and the electric connection sealing portion 1007. Thus, to be hardened, the sealing compound is heated. Because of the applied heat, after cooling, stress is generated inside a nozzle forming member described below and forming a nozzle in the print element substrate 1108. However, the present embodiment differs from the conventional art in that a part of the nozzle forming member which is located in the vicinity of the area in which the test terminals 1025 are arranged is separated from the nozzle forming member located in the remaining area. This will be described below.

Figure 2:
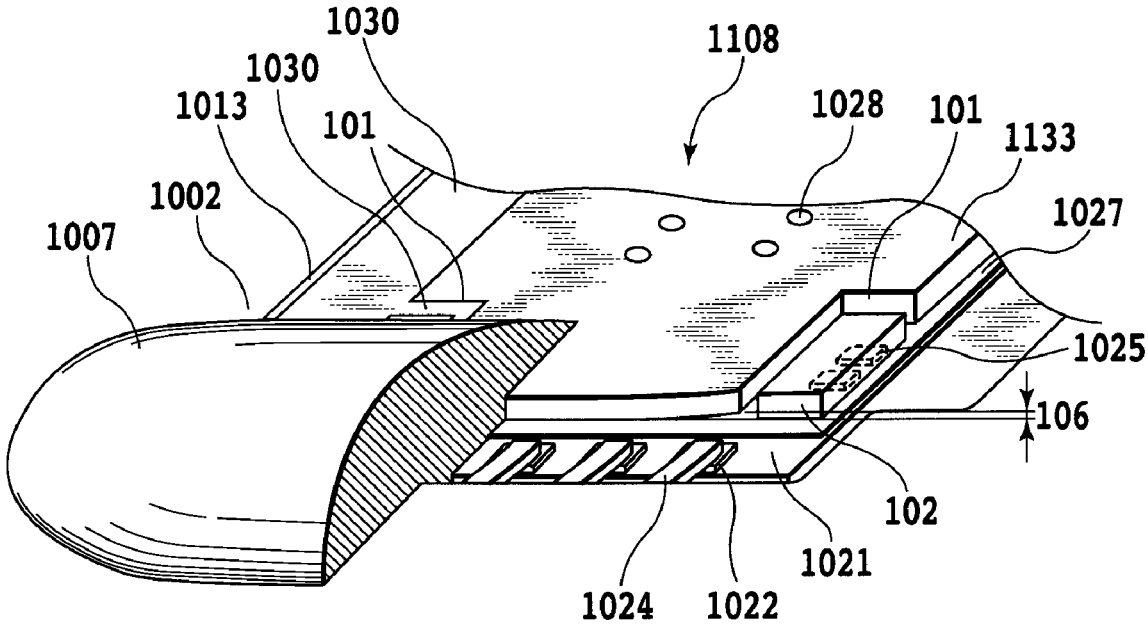
FIG. 2 is an enlarged perspective view showing a print element substrate in a print head according to a first embodiment.
Figure 9:
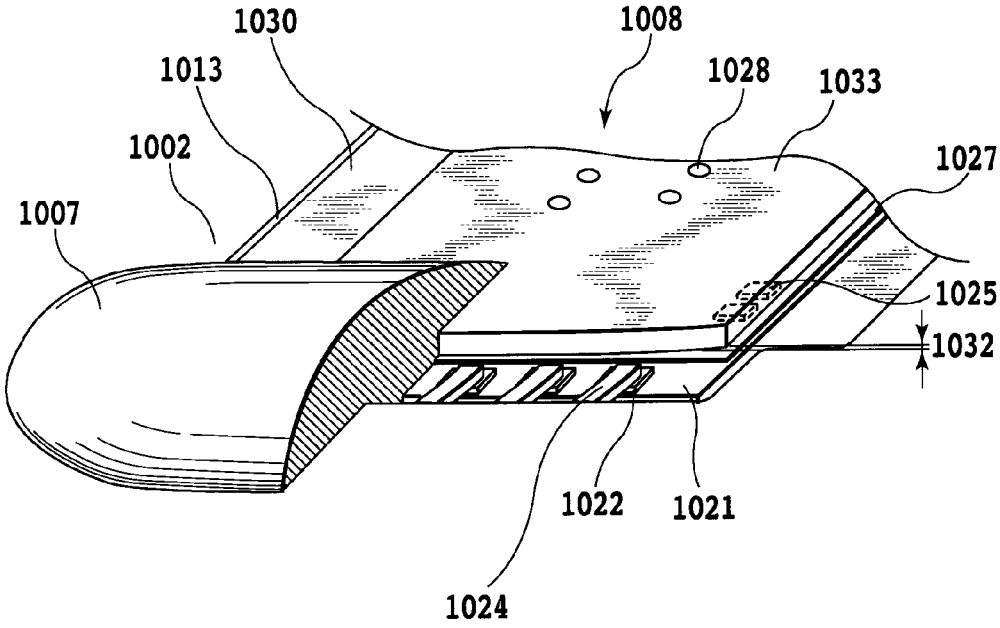
FIG. 9 is an enlarged perspective view of a part of a portion of the conventional print head which ejects ink.
Figure 10:
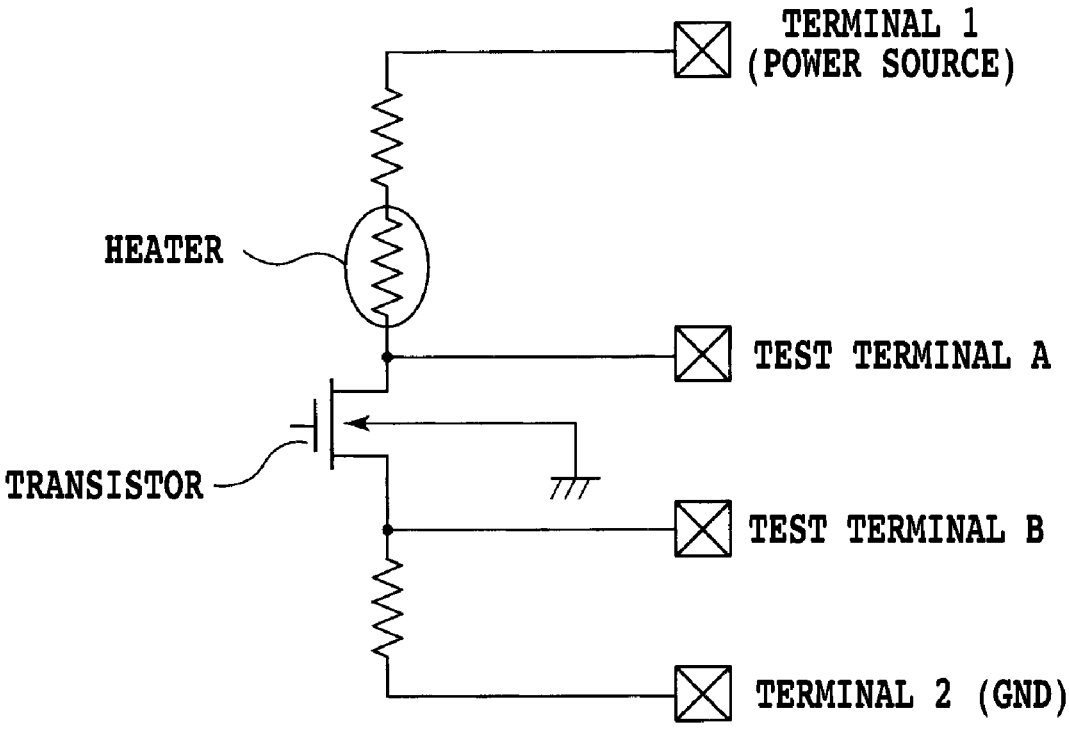
FIG. 10 is a circuit diagram showing a part of a circuit on a substrate with test terminals.

FIG. 2 is an enlarged perspective view of the print element substrate 1108 in the print head 1101 according to the present embodiment. The same components as those in FIG. 9 are denoted by the same reference numerals. In the present embodiment, heaters that are transducing elements, elements for driving, a plurality of test terminals 1025 for inspections, and connection terminals 1022 are patterned on the substrate 1021 as is the case with the conventional art; leads 1024 from the electric wiring substrate 1002 are joined to the respective connection terminals 1022. A gold bump of thickness 5 μm is plated on the surface of each of the test terminals 1025 as is the case with the connection terminal 1022. Gold may be laminated on the surface of the test terminal 1025. An intermediate layer 1027 such as an insulating layer or a tight-contact assisting layer is provided between the nozzle forming member 1108 and the substrate 1021.

A recess portion 101 is formed between a nozzle forming member 102 located in the vicinity of the test terminals 1025 and another nozzle forming member 1133 so as to prevent the nozzle forming member 102 from being affected by the stress or the like of the nozzle forming member 1133. The recess portion 101 separates the nozzle forming member 102 (first member) from the nozzle forming member 1133 (second member). A thermosetting sealing compound is filled in the recess portion 101. However, the recess portion 101 has a reduced area, and only a small amount of sealing compound is thus filled into the recess portion 101. Furthermore, the nozzle forming member 102 also has a reduced volume. Thus, even though the sealing compound is heated so as to be hardened and then cooled, only a small stress is generated inside the nozzle forming member 102. Possible warpage is thus prevented. This in turn prevents an end of the nozzle forming member from being peeled off to create a gap as in the case of the conventional art. The test terminals 1025 are inhibited from coming into contact with ink or moisture and being caused trouble or damaging other circuits or wires.

As described above, the nozzle forming member located in the vicinity of the area with the test terminals 1025 arranged therein is separated from the nozzle forming member located in the remaining area so as to have a reduced volume. This reduces possible stress on the nozzle forming member located in the vicinity of the area with the test terminals arranged therein. This in turn prevents the end of the nozzle forming member from being peeled off to create a gap, thus inhibiting the test terminals and wires from being caused trouble or damaged.

Second Embodiment

A second embodiment of the present invention will be described below with reference to the drawings. The basic configuration of the present embodiment is similar to that of the first embodiment. Thus, only the characteristic arrangements of the present embodiment will be described below.

Figure 3:
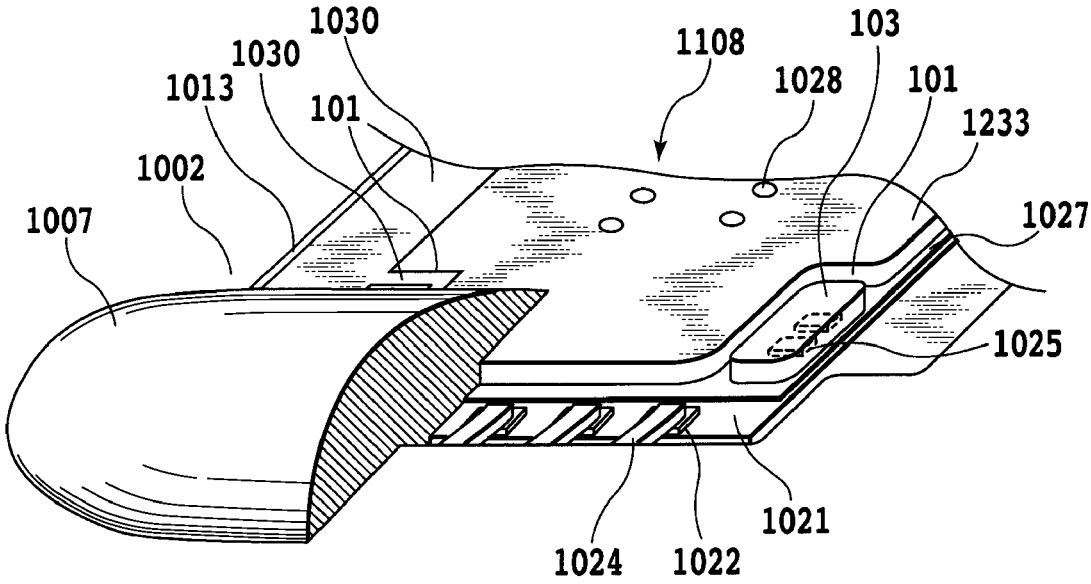
FIG. 3 is an enlarged perspective view showing a print element substrate in a print head according to a second embodiment.

FIG. 3 is an enlarged perspective view of a print element substrate 1208 in a print head according to the present embodiment. The same components as those in FIG. 9 are denoted by the same reference numerals. A recess portion 101 is formed between a nozzle forming member 103 located in the vicinity of test terminals 1025 and another nozzle forming member 1233 so as to prevent the nozzle forming member 103 from being affected by the stress or the like of the nozzle forming member 1233. Thus, in the present embodiment, the recess portion 101 separates the nozzle forming member 103 from the nozzle forming member 1233 as is the case with the first embodiment.

The nozzle forming member 103, located in the vicinity of the test terminals 1025, is formed to have a reduced volume. Thus, during cooling, a reduced stress is generated on the nozzle forming member 103, which is thus not substantially peeled off. However, the nozzle forming member 103 may be slightly peeled off at a peripheral portion, particularly in corners thereof. Thus, in the present embodiment, to prevent this, the four corners of the nozzle forming member 103 and the particular corners of the nozzle forming member 1233 which are located in the vicinity of the test terminals 1025, are shaped like circular arcs (rounded).

In the present embodiment, the corners of the nozzle forming member are shaped like circular arcs (rounded). However, the corners of the nozzle forming member may be subjected to what is called chamfering.

As described above, the nozzle forming member located in the vicinity of the area with the test terminals arranged therein is formed separately from the nozzle forming member located in the remaining area so as to reduce the volume of the former nozzle forming member. Furthermore, the corners of the nozzle forming member are shaped like circular arcs. This prevents an end of the nozzle forming member from being peeled off to create a gap, thus inhibiting test terminals and wires from being caused trouble or damaged.

Third Embodiment

A third embodiment of the present invention will be described below with reference to the drawings. The basic configuration of the present embodiment is similar to that of the first embodiment. Thus, only the characteristic arrangements of the present embodiment will be described below.

Figure 4:
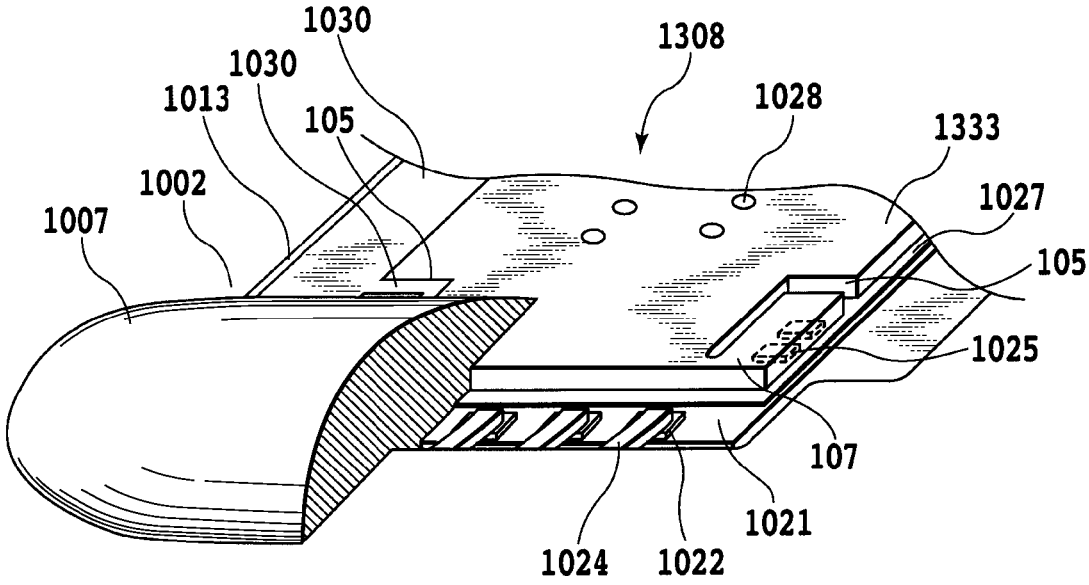
FIG. 4 is an enlarged perspective view showing a print element substrate in a print head according to a third embodiment.

FIG. 4 is an enlarged perspective view of a print element substrate 1308 in a print head according to the present embodiment. The same components as those in FIG. 9 are denoted by the same reference numerals. A recess portion 105 is formed to reduce the adverse effect of the stress of a nozzle forming member 1333 on a nozzle forming member 107 located in the vicinity of test terminals 1025. The nozzle forming member 107, located in the vicinity of the test terminals 1025, is not completely separated from the nozzle forming member 1333 but is partly connected to the nozzle forming member 1333 for integration. However, only a very small part of the nozzle forming member 107 is connected to the nozzle forming member 1333. Furthermore, the nozzle forming member 107, located in the vicinity of the test terminals 1025, is formed so as to have a reduced volume. This reduces a possible stress in the nozzle forming member 107 during cooling. Thus, the nozzle forming member 107 is prevented from being warped and peeled off from an intermediate layer 1027. Additionally, also in the present embodiment, the recess portion 105 is normally filled with a sealing compound 1030 or a sealing compound making up an electric connection sealing portion 1007. Also in the present embodiment, the corners of the nozzle forming member located in the vicinity of the test terminals may be rounded or chamfered as described in the second embodiment.

As described above, the recess portion is formed so as to reduce the volume of the nozzle forming member located in the vicinity of the area with the test terminals arranged therein and to reduce the adverse effect of the stress of the nozzle forming member located in the remaining area. Then, although the nozzle forming member located in the vicinity of the area with the test terminals arranged therein is not completely separated from the nozzle forming member located in the remaining area, the possible stress on the former nozzle forming member is reduced to prevent the end thereof from being peeled off to create a gap. This inhibits the test terminals and wires from being caused trouble or damaged.

Fourth Embodiment

A fourth embodiment of the present invention will be described below with reference to the drawings. The basic configuration of the present embodiment is similar to that of the first embodiment. Thus, only the characteristic arrangements of the present embodiment will be described below.

Figure 5:
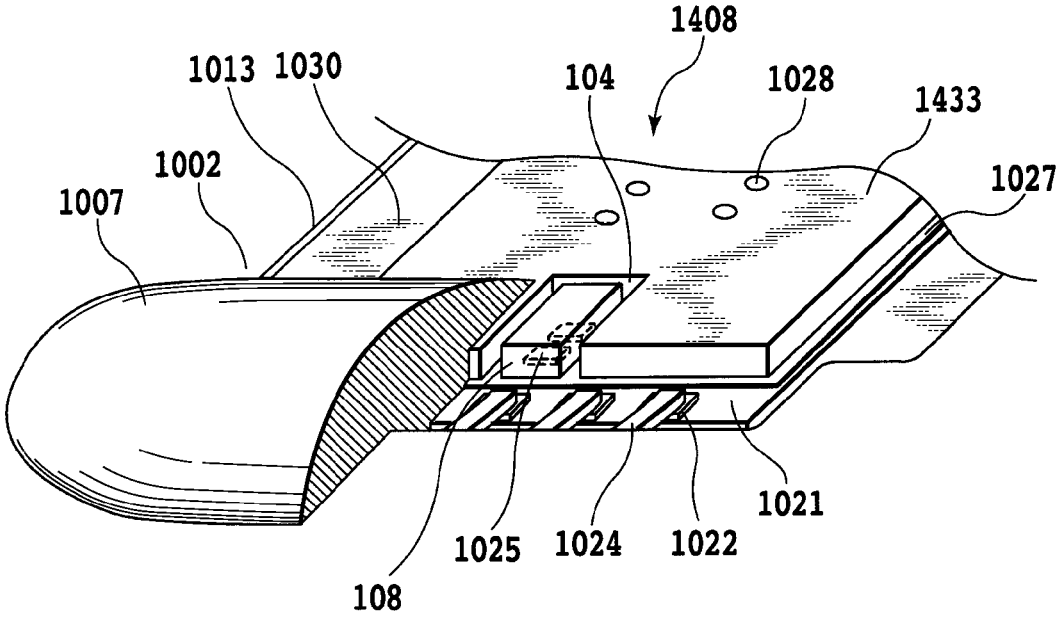
FIG. 5 is an enlarged perspective view showing a print element substrate in a print head according to a fourth embodiment.

FIG. 5 is an enlarged perspective view of a print element substrate 1408 in a print head according to the present embodiment. The same components as those in FIG. 9 are denoted by the same reference numerals. In the present embodiment, test terminals 1025 are arranged in an area of the print element substrate 1408 which is different from the corners thereof. The test terminals 1025 are formed in an intermediate portion of one side forming a nozzle forming member 1433 rather than in a corner of the nozzle forming member 1433. A gold bump of thickness 5 μm is plated on the surface of each of the test terminals 1025 as is the case with connection terminals.

A recess portion 104 is formed between a nozzle forming member 108 located in the vicinity of the test terminals 1025 and another nozzle forming member 1433 so as to prevent the nozzle forming member 108 from being affected by the stress or the like of the nozzle forming member 1433. A thermosetting sealing compound is filled in the recess portion 104. However, the recess portion 104 has a reduced area, and only a small amount of sealing compound is thus filled into the recess portion 104. Furthermore, the nozzle forming member 108 also has a reduced volume. Thus, even though the sealing compound is heated so as to be hardened and then cooled, only a small stress is generated inside the nozzle forming member 108.

As described above, the nozzle forming member located in the vicinity of the area with the test terminals arranged therein is separated from the nozzle forming member located in the remaining area so as to have a reduced volume. This reduces possible stress on the nozzle forming member located in the vicinity of the area with the test terminals arranged therein. This in turn prevents the end of the nozzle forming member from being peeled off to create a gap, thus inhibiting the test terminals and wires from being caused trouble or damaged.

Fifth Embodiment

A fifth embodiment of the present invention will be described below with reference to the drawings. The basic configuration of the present embodiment is similar to that of the first embodiment. Thus, only the characteristic arrangements of the present embodiment will be described below.

Figure 6:
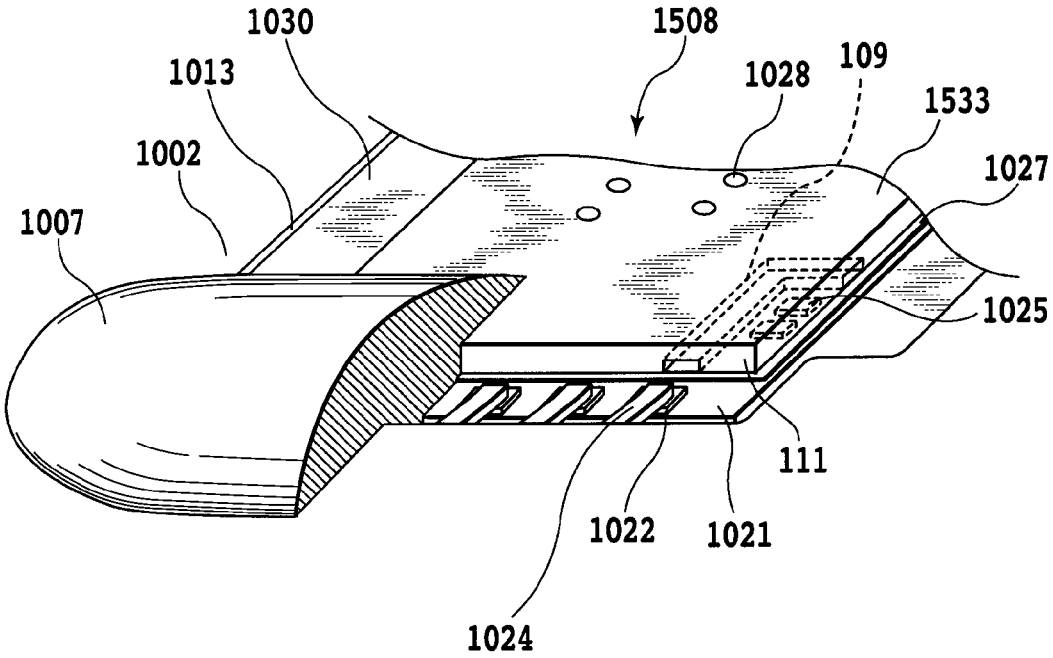
FIG. 6 is an enlarged perspective view showing a print element substrate in a print head according to a fifth embodiment.

FIG. 6 is an enlarged perspective view of a print element substrate 1508 in a print head according to the present embodiment. The same components as those in FIG. 9 are denoted by the same reference numerals. In the present embodiment, a recess portion 109 is formed to prevent a nozzle forming member 111 located in the vicinity of test terminals 1025 from being affected by the stress or the like of another nozzle forming member 1033. A sealing compound is filled in the recess portion 109. A gold bump of thickness 5 μm is plated on the surface of each of the test terminals 1025 as is the case with connection terminals.

The recess portion 109 is formed as follows. An intermediate layer 1027 is patterned on a substrate 1021. In a step of forming a nozzle (not shown in the drawings), the same profile is patterned into a desired shape. A nozzle forming member is applied to the resulting profile and then patterned and hardened. The profile is then removed with a solvent. The nozzle forming member 111, located in the vicinity of the test terminals 1025, is entirely connected to the nozzle forming member 1033 except for the tunnel-shaped recess portion 109 with an intermediate layer 1027 as a bottom surface. However, the nozzle forming member 111 is sufficiently prevented from being affected by the stress or the like of the nozzle forming member 1033. The nozzle forming member 111, located in the vicinity of the test terminals 1025, is formed to have a reduced volume. Thus, during cooling, a reduced stress is generated in the nozzle forming member 111. Thus, the nozzle forming member 111 is substantially prevented from being peeled off from the intermediate layer 1027.

As described above, the recess portion is formed so as to reduce the volume of the nozzle forming member located in the vicinity of the area with the test terminals arranged therein and to reduce the adverse effect of the stress of the nozzle forming member located in the remaining area. Then, although the nozzle forming member located in the vicinity of the area with the test terminals arranged therein is not completely separated from the nozzle forming member located in the remaining area, the possible stress on the former nozzle forming member is reduced to prevent the end thereof from being peeled off to create a gap. This inhibits the test terminals and wires from being caused trouble or damaged.

Sixth Embodiment

A sixth embodiment of the present invention will be described below with reference to the drawings. The basic configuration of the present embodiment is similar to that of the first embodiment. Thus, only the characteristic arrangements of the present embodiment will be described below.

Figure 7:
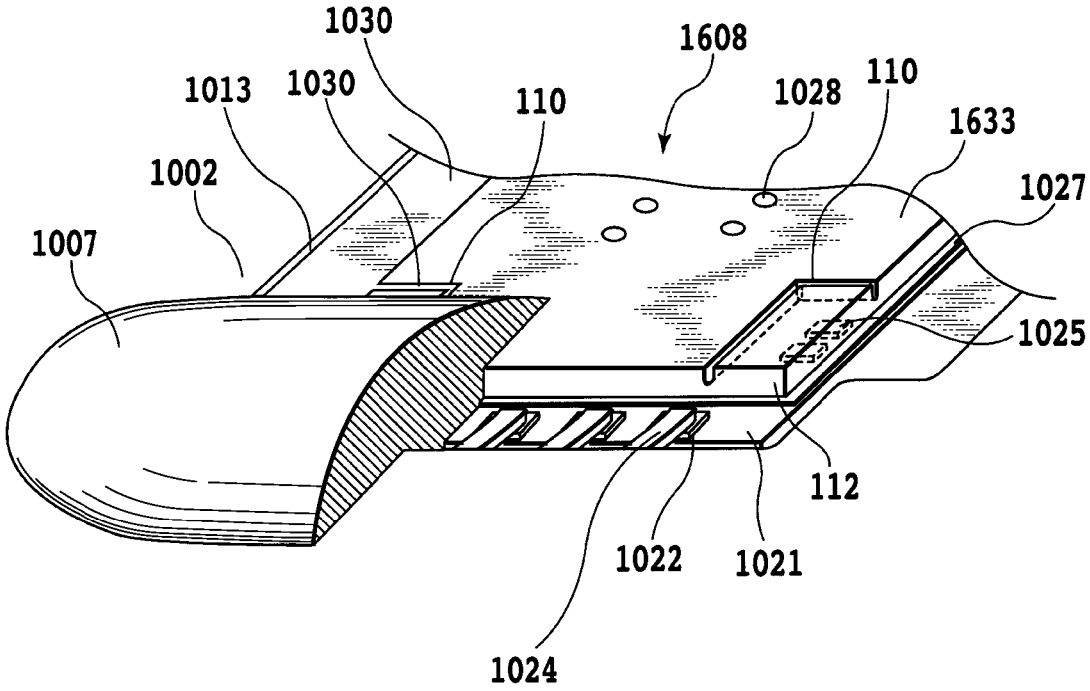
FIG. 7 is an enlarged perspective view showing a print element substrate in a print head according to a sixth embodiment.
Figure 8:
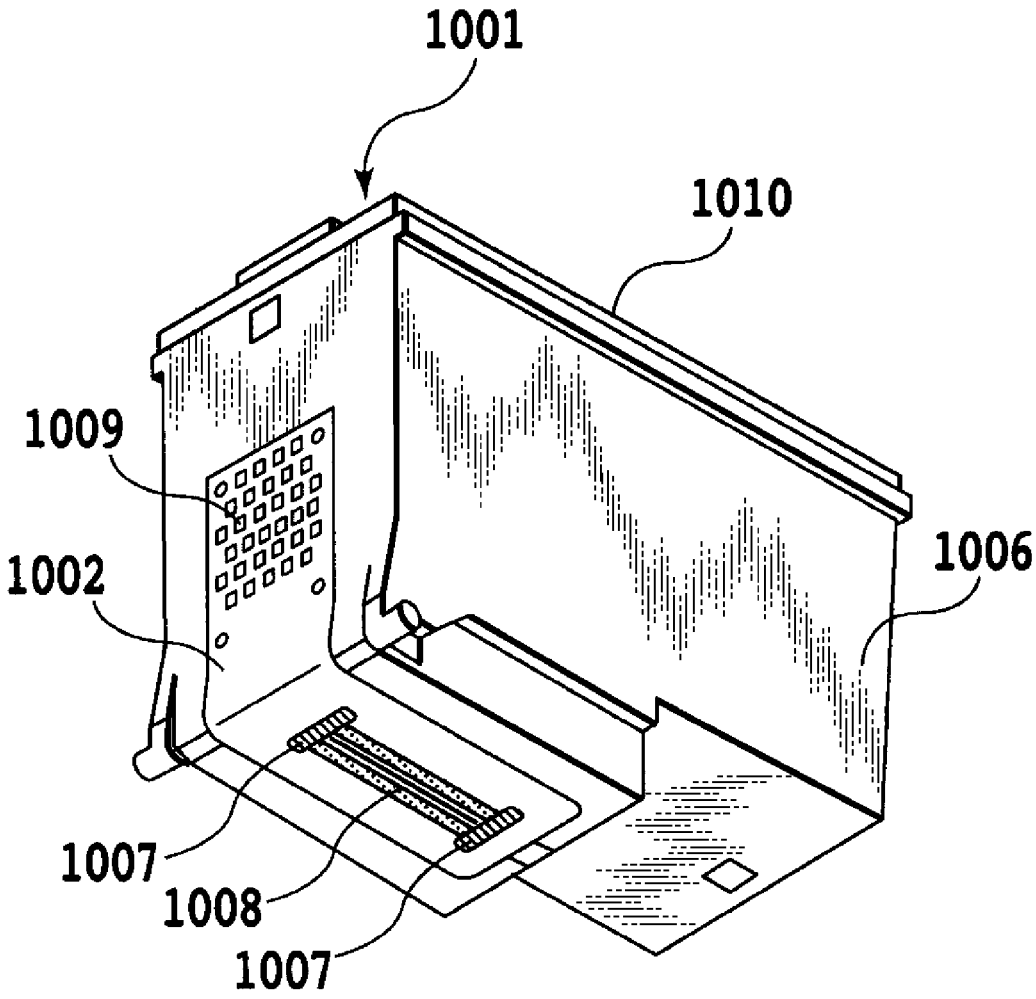
FIG. 8 is a diagram showing a print head which is a conventional example and which ejects pigment black ink.

FIG. 7 is an enlarged perspective view of a print element substrate 1608 in a print head according to the present embodiment. The same components as those in FIG. 9 are denoted by the same reference numerals. In the present embodiment, a recess portion 110 is formed to prevent a nozzle forming member 112 located in the vicinity of test terminals 1025 from being affected by the stress or the like of another nozzle forming member 1633. A sealing compound is filled in the recess portion 110. A gold bump of thickness 5 μm is plated on the surface of each of the test terminals 1025 as is the case with connection terminals.

The recess portion 110 is formed as follows. An intermediate layer 1027 is patterned on a substrate 1021. A nozzle forming member that is a photo-setting resin is applied to the intermediate layer 1027 and patterned. At this time, the nozzle forming member is exposed in a pattern narrower than a line width over which the nozzle forming member can be patterned over a thickness to the intermediate layer. Alternatively, similar effects are produced by using a mask having means for reducing transmittance so as to form the shape of the recess pattern 110.

The nozzle forming member 112, located in the vicinity of test terminals 1025, is connected to the outside nozzle forming member 1633 in an area closer to the intermediate layer 1027 than to the half-cut recess portion 110. However, recess portion 110 sufficiently prevents the nozzle forming member 112 from being affected by the stress or the like of the nozzle forming member 1633. The nozzle forming member 112, located in the vicinity of the test terminals 1025, is formed to have a reduced volume. Thus, during cooling, a reduced stress is generated in the nozzle forming member 112. Thus, the nozzle forming member 112 is substantially prevented from being peeled off from the intermediate layer 1027.

In the present embodiment, the corners of the nozzle forming member 112, located in the vicinity of the test terminals, may be rounded or chamfered as described in the second embodiment.

As described above, the recess portion is formed so as to reduce the volume of the nozzle forming member located in the vicinity of the area with the test terminals arranged therein and to reduce the adverse effect of the stress of the nozzle forming member located in the remaining area. Then, although the nozzle forming member located in the vicinity of the area with the test terminals arranged therein is not completely separated from the nozzle forming member located in the remaining area, the possible stress on the former nozzle forming member is reduced to prevent the end thereof from being peeled off to create a gap. This inhibits the test terminals and wires from being caused trouble or damaged.

In the above-described embodiments, the ink jet print head for black ink is cited by way of example. However, the present invention does not limit the color of ink or the like but is applicable to all ink jet print heads in which stress may be applied to the nozzle forming member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-158204, filed Jun. 17, 2008, which is hereby incorporated by reference herein in its entirety.

What is claimed is:

1. An ink jet print head comprising:

a substrate comprising a circuit having an energy generating element which generates energy used to eject ink and a test terminal for inspecting the circuit, a nozzle forming member joined to the substrate, the nozzle forming member comprising a nozzle for ejecting an ink, a first portion formed at a position corresponding to the test terminal, a second portion formed at a position corresponding to the circuit, and a recess portion which divides the first portion and the second portion, wherein the test terminal is covered with the first portion of the nozzle forming member, and the volume of the first portion is smaller than the volume of the second portion.

2. The ink jet print head according to claim 1, wherein the recess portion is filled with a sealing compound.

3. The ink jet print head according to claim 1, wherein at least some corners of the first portion of the nozzle forming member are shaped as circular arcs.

4. The ink jet print head according to claim 1, wherein at least some corners of the first portion of the nozzle forming member are chamfered.

5. The ink jet print head according to claim 1, wherein a plurality of the test terminals are provided, and at least one of the test terminals has gold laminated on a surface thereof.

6. The ink jet print head according to claim 1, wherein an intermediate layer is provided between the nozzle forming member and the substrate.

7. The ink jet print head according to claim 6, wherein the intermediate layer is an insulating layer.

8. The ink jet print head according to claim 6, wherein the intermediate layer is a tight-contact assisting layer.

9. The ink jet print head according to claim 6, wherein the recess portion is formed like a tunnel in the nozzle forming member so that the intermediate layer corresponds to a base surface of the recess portion.

10. The ink jet print head according to claim 1, where the first portion and the second portion are connected through the recess portion.

11. The ink jet print head according to claim 1, where the first portion and the second portion are divided by the recess portion, and the first portion and the second portion are mutually independent.

* * * * *